US005862444A

United States Patent [19]

Machida et al.

[11] Patent Number: 5,862,444

[45] Date of Patent: Jan. 19, 1999

[54] DEVELOPING ROLLER HAVING ANOTHER COATING OF FINE PARTICLES

[75] Inventors: Junji Machida, Toyonaka; Shuichi Nakagawa, Suita; Hiroshi Goto, Itami; Yoichi Fujieda, Nishinomiya; Ryuji Inoue, Itami; Chikara Tsutsui, Nishinomiya, all of Japan

[73] Assignee: Minolta Co., Ltd., Osaka, Japan

[21] Appl. No.: 839,784

[22] Filed: Apr. 16, 1997

[30] Foreign Application Priority Data

| | | | |
|---|---|---|---|
| Apr. 18, 1996 | [JP] | Japan | 8-122392 |
| Apr. 18, 1996 | [JP] | Japan | 8-122393 |
| Apr. 24, 1996 | [JP] | Japan | 8-129024 |

[51] Int. Cl.[6] ..... G03G 15/08

[52] U.S. Cl. ..... 399/286; 492/25; 492/28

[58] Field of Search ..... 399/265, 284, 399/286, 274, 276; 492/24, 25, 28, 48

[56] References Cited

U.S. PATENT DOCUMENTS

| | | | |
|---|---|---|---|
| 4,564,285 | 1/1986 | Yasuda et al. | 399/274 |
| 4,989,044 | 1/1991 | Nishimura et al. | 399/276 X |
| 5,563,690 | 10/1996 | Hasegawa et al. | 399/286 |

FOREIGN PATENT DOCUMENTS 7-306586 11/1995 Japan .

*Primary Examiner*—William Royer
*Attorney, Agent, or Firm*—McDernott, Will & Emery

[57] ABSTRACT

A development system that contains a developer carrier for carrying a developer on the surface thereof to a development region opposite to an image bearing body, and a regulating member biased into contact with the surface of the developer carrier by a predetermined pressure for regulating an amount of developer carried by a developer transport member. The developer carrier has a surface coated with fine particles with an average particles size of between 3 and 30 $\mu$m which are bonded with the surface.

16 Claims, 1 Drawing Sheet

DEVELOPING ROLLER HAVING ANOTHER COATING OF FINE PARTICLES

BACKGROUND ART

1. Field of the Invention

The present invention relates generally to a development system for use in image forming apparatuses, such as copying machines, printers and the like. The development system is adapted to develop an electrostatic latent image formed on an image bearing body and more particularly, arranged such that a developer transport member carries thereon a toner to a development region opposite to the image bearing body for development of the image. A toner regulating member bears against the surface of the developer transport member for regulating the amount of toner carried by the developer transport member and also for triboelectrically charging the toner supplied to the development region.

2. Description of the Related Art

Conventionally, the image forming apparatuses, such as copiers, printers and the like, have employed various types of development systems for developing the electrostatic latent image formed on the image bearing body.

The development systems typically known in the art include a development system utilizing a two-component type developer comprising a magnetic carrier and a toner and a development system utilizing a one-component type developer containing no magnetic carrier.

The most common development system utilizing the one-component type developer is arranged such that the developer transport member carries thereon the toner to the development region opposite to the image bearing body for development of the image while the toner regulating member bears against the surface of the developer transport member for regulating the amount of toner carried by the developer transport member and also for triboelectrically charging the toner supplied to the development region.

Unfortunately, in the arrangement wherein the toner regulating member bears against the surface of the developer transport member for regulation of the amount of toner carried by the developer transport member, the toner becomes fixed to the developer transport member, forming a toner film thereon. Hence, an uneven amount of toner is supplied by the developer transport member. This causes a resultant image to suffer irregularities such as density variation.

If the developer transport member has too small roughness on the surface thereof, a reduced amount of toner is carried by the developer transport member. If the reduced amount of toner on the developer transport member is regulated by the toner regulating member, the toner is excessively charged. This causes the resultant image to suffer an insufficient image density or density variation, although the production of an image with defects such as all over fog is avoided.

On the other hand, if the developer transport member has too great roughness on the surface thereof, the developer transport member carries thereon an excessive amount of toner. If the excessive amount of toner on the developer transport member is regulated by the toner regulating member, the toner fails to be adequately charged. This results in an image containing fog all over or an image with toner particles scattered around characters.

Proposed solutions to the above problems include development systems wherein a developer transport member is provided with a layer of specific fine particles bonded to the surface thereof that also contains a nickel coating electrodeposited on the surface of the layer of fine particles, and development systems wherein a surface layer comprising a binder resin containing specific fine particles dispersed therein is laid over the developer transport member (see, for example, Japanese Unexamined Patent Publication No.7 (1995)-306586), and the like.

In the developer transport member that contains the layer of fine particles bonded to the surface thereof and further contains the nickel coating electrodeposited on the fine particles, or the developer transport member that contains a surface layer comprising binder resin with fine particles dispersed therein, the fine particles are not adequately exposed to the surface of the developer transport member. This results in a failure of imparting a uniform roughness to the surface of the developer transport member. Thus making it difficult for the toner regulating member to suitably regulate the amount of toner on the developer transport member or to adequately charge the toner, particularly when high speed image development is performed. Consequently, the resultant images still suffer irregularities such as density variation, allover fog and the like. There also exists a problem of poor reproducibility of fine lines and dots.

SUMMARY OF THE INVENTION

It is therefore, an object of the present invention to overcome the foregoing drawbacks of development systems arranged such that the developer transport member carries thereon toner to the development region opposite to the image, bearing body for development of the image while the toner regulating member bears against the surface of the developer transport member, thus regulating the amount of toner carried by the developer transport member and also for triboelectrically charging the toner supplied to the development region.

More specifically, an object of the invention is to allow the toner regulating member to suitably regulate the amount of toner carried by the developer transport member.

Another object of the invention is to allow the toner regulating member to suitably charge the toner carried by the developer transport member.

Still another object of the invention is to provide favorable images free from irregularities such as density variation, allover fog and the like.

Yet another object of the invention is to provide favorable images excellent in the reproducibility of fine lines and dots.

A development system according to a first embodiment of the invention comprises a developer carrier for carrying a developer on the surface thereof to a development region opposite to an image bearing body, and a regulating member biased into contact with the surface of the developer carrier by a predetermined pressure for regulating an amount of toner carried by a developer transport member. The developer carrier has a surface coated with fine particles with an average particles size of between 3 and 30 $\mu$m which are bonded with the surface.

In the development system of the first embodiment of the invention, the fine particles with the average particle size of from 3 to 30 $\mu$m are bonded to the surface of the developer transport member. That is, if fine particles smaller than 3 $\mu$m in the average particle size are bonded to the surface of the developer transport member, the developer transport member has such small roughness on the surface thereof that the developer transport member is reduced in the transportability of the toner. If the reduced amount of toner on the developer transport member is regulated by the toner regulating member, an even smaller amount of toner is supplied to the development region, resulting in the production of an image with insufficient image density or with density variation. If, on the other hand, fine particles greater than 30 μm in average particle size are bonded to the surface of the developer transport member, the developer transport member carries thereon an excessive amount of toner. The toner regulating member, in turn, fails to fully charge the excessive amount of toner on the developer transport member, while regulating the amount of toner thereon. This results in the production of an image fogged all over or an image with toner particles scattered around characters.

If the fine particles with the average particle size of between 3 and 30 μm are uniformly bonded to the surface of the developer transport member to form a layer thereon, as suggested by the development system of the first embodiment of the invention, the developer transport member has suitable roughness on the surface thereof. This enables the developer transport member to carry a suitable amount of toner and also enables the toner regulating member to suitably charge the toner as regulating the amount of toner on the developer transport member. Thus stable production of favorable images free from allover fog or density variation is assured. Incidentally, a more preferred average particle size of the fine particles bonded to the surface of the developer transport member is in a range of between 5 and 25 μm.

A development system according to a second embodiment of the invention comprises a developer carrier for carrying a developer on the surface thereof to a development region opposite to an image bearing body, and a regulating member biased into contact with the surface of the developer carrier by a predetermined pressure for regulating an amount of toner carried by a developer transport member, the developer carrier having a surface coated with fine particles with an average particles size of between 3 and 30 μm which are bonded with the surface, said fine particles having a volume resistivity between $10^5$ and $10^{13}$ Ω·cm.

In the development system of the second embodiment of the invention, fine particles with the volume resistivity of between $10^5$ and $10^{13}$ Ω·cm are used. That is, if the fine particles have a volume resistivity smaller than $10^5$ Ω·cm, current leakage occurs in the developer transport member with such fine particles bonded thereto when a developing bias voltage is applied to the developer transport member for development of the image. Such leakage causes the resultant image to suffer density variation or image disturbances. If, on the other hand, the fine particles have a volume resistivity greater than $10^{13}$ Ω·cm, a sufficiently effective electric field is not produced when the developing bias voltage is applied to the developer transport member for development of the image. This results in a failure of producing an image with sufficient image density or reduction in the reproducibility of fine lines or dots.

If the fine particles with the average particle size of between 3 and 30 μm and the volume resistivity of between $10^5$ and $10^{13}$ Ω·cm are uniformly bonded to the surface of the developer transport member to form the layer thereon, as suggested by the development system of the second embodiment of the invention, the developer transport member has a suitable roughness on the surface thereof. This enables the developer transport member to carry a suitable amount of toner and also enables the toner regulating member to suitably charge the toner, thereby assuring the stable production of favorable images free from allover fog or density variation. The development system of this mode also prevents current leakage when the developing bias voltage is applied to the developer transport member, so that an adequate electric field is produced in the development region. Thus stable production of favorable images free from density variation or image disturbances, rich in image density, and excellent in reproducibility of fine lines and dots is assured.

These and other objects, advantages and features of the invention will become apparent from the following description thereof taken in conjunction with the accompanying drawings which illustrate specific embodiments of the invention.

DESCRIPTION OF THE PREFERRED EMBODIMENTS

Figure 1:
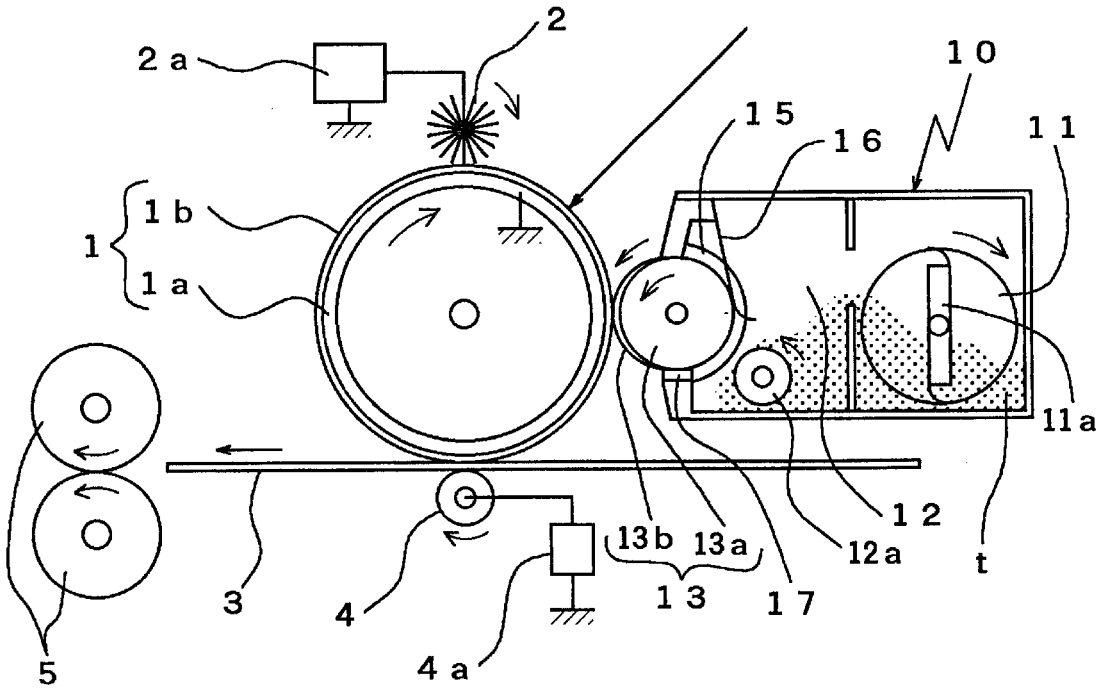
FIG. 1 is a schematic diagram illustrating a state in which an image forming operation is performed by the development system according to a mode of the invention.

The development system of the invention is arranged such that the developer transport member carries toner thereon to the development region opposite to the image bearing body, thereby developing an image while the toner regulating member bears against the surface of the developer transport member for regulating the amount of toner carried by the developer transport member and also for triboelectrically charging the toner supplied to the development region.

The developer transport member has the surface thereof covered by an adhesive layer, to which fine particles having the average particle size of between 3 and 30 μm are bonded, thereby forming a layer of the fine particles thereon.

In the case where the toner particles carried on the developer transport member closely resemble the shape of the fine particles bonded to the surface of the developer transport member, the toner regulating member cannot triboelectrically impart an adequate electric charge to the toner. On the other hand, in the case where the toner particles and the fine particles have a significant difference in shape, the toner regulating member may scrape off the fine particles from the surface of the developer transport member or break the toner particles, while regulating the amount of toner on the developer transport member. This reduces the durability of the developer transport member or results in the production of ultra-fine particles, which may adversely affect the resultant images.

To overcome such drawbacks, the development system of the invention satisfies the condition of $10 \leqq |A-B| \leqq 80$, or, more preferably of $15 \leqq |A-B| \leqq 70$, wherein "A" denotes a value of shape factor SF-1 of the toner used for the image development, and "B" denotes a value of shape factor SF-1 of the fine particles bonded to the surface of the developer transport member. In determining the shape factors SF-1 of the toner and of the fine particles, an image analyzer (available commercially as Luzex 5000 from Japan Regulator Co.,Ltd.) was used to measure a maximum length L and an area S of each projected image of the toner particles and the fine particles thereby finding the average values of L and S, respectively. The values thus found were substituted in the following expression so as to find the respective shape factors of the toner particles and the fine particles:

$$SF\text{-}1=(L^2/S)\times(\pi/4)\times 100$$

It is to be noted that the shape factor SF1 is used as a parameter indicative of a difference between a greater diameter and a smaller diameter of a particle, or a degree of the spheriodicity of a particle. The closer to sphere the particle is shaped, the closer to 100 the shape factor is.

Typical examples of the fine particles include fine particles formed of thermosetting resins or thermoplastic resins such as styrene, acrylic, styrene-acrylic, silicone, benzoguanamine, polyethylene, polypropylene, fluororesins, nylon, phenol, urethane and the like, and inorganic fine particles such as magnetic powder, ferrite particles, alumina particles, silica particles, titanium particles, aluminum powder, zinc powder, copper powder, nickel powder, stainless steel powder, iron powder, tungsten powder, molybdenum powder, beryllium powder, silicon carbide powder, boron carbide powder, cerium powder, lanthana powder, silicon nitride powder, glass powder, glass bead, graphite powder and the like. Additionally, the above fine particles may be subject to surface treatment using a silane coupling agent, a titanium coupling agent, silicone oil or the like.

In the case where the fine particles with a volume resistivity of between $10^5$ and $10^{13}$ Ω·cm are used, an electrically-conductive material is added to any of the above resin fine particles. Typical examples of the electrically-conductive material include acetylene black, Ketchen black, graphite, magnetic powder, ferrite particles, tin oxide, zinc oxide, molybdenum oxide, antimony oxide, kalium titanate and the like.

On the other hand, conventionally known toners comprising at least a binder resin and a colorant are usable as the toner for use in the development system of the invention.

If the binder resin contained in the toner has a glass transition point Tg lower than 55° C., the toner suffers poor stability during storage. If the binder resin has a glass transition point Tg higher than 75° C., the toner has reduced fixing characteristic with respect to copy paper. Hence, the glass transition point Tg of the binder resin is preferably in the range of between 55° and 75° C., or more preferably between 58 ° and 68° C. If the binder resin has a softening point lower than 80° C., the toner has reduced stability during storage. If, on the other hand, the softening point thereof has higher than 170° C., the toner is reduced fixing characteristic. It is therefore desirable that the binder resin has a softening point of between 80° and 170° C., or more desirably between 90° and 150° C.

Resins typically known in the art are usable as the binder resin. It is preferred to use a resin such as polyester, modified polyester urethane or the like.

Conventional colorants for use in the toner are usable in the toner of the invention. Typical examples of a black colorant include carbon black, cupric oxide, manganese black, aniline black, activated carbon and the like. The above black colorants may be used alone or in combination of two or more types. Typical examples of a yellow colorant for use in the full-color toner include chrome yellow, zinc yellow, cadmium yellow, yellow oxide, Mineral Fast Yellow, Nickel-Titanium Yellow, Nables Yellow, Naphthol Yellow S, Hansa Yellow G, Hansa yellow 10G, Benzidine Yellow G, Benzidine Yellow GR, quinoline yellow lake, Permanent Yellow NCG, tartrazine lake and the like. Typical examples of a red colorant include chrome orange, molybdenum orange, Permanent Orange GTR, pyrazolone orange, vulcan orange, Benzidine Orange G, Permanent Red 4R, Lake Red D and the like. Typical examples of a blue colorant include Prussian blue, cobalt blue, phthalocyanine blue, Victoria Blue Lake and the like.

The above colorants are preferably incorporated in the toner in the amount of between 1 and 20 parts, or more preferably between 3 and 15 parts per 100 parts by weight of the binder resin.

In addition to the binder resin and the colorants, the toner may incorporate, as required, a charge control agent, an anti-offset agent, a fluidizing agent and the like.

Examples of a suitable charge control agent include azo dyes of chromium complex salt, copper phthalocyanine dyes, zinc complex salt, aluminum complex salt, calixarenes and the like. The charge control agent is preferably added to the toner in the amount of between 0.5 and 8 parts, or more preferably between 1 and 5 parts by weight per 100 parts by weight of the binder resin.

Examples of a suitable anti-offset agent include a low-molecular-weight polyolefin wax, oxidized low- molecular-weight polyolefin wax, carnauba wax, Saxol wax, Candelilla wax, jojoba oil wax and the like. The above anti-offset agent may be used alone or in combination of two or more types. The anti-offset agent is preferably added to the toner in the amount of between 0.1 and 6 parts, or more preferably between 2 and 6 parts by weight per 100 parts by weight of the binder resin. The anti-offset agent preferably has a softening point of between 70° and 150° C. and an acid value of between 1 and 40 KOHmg/g.

Examples of a suitable fluidizing agent include inorganic fine particles such as of silica, titanium dioxide, alumina, magnesium fluoride, silicon carbide and the like. It is preferred that the fine particles are treated with a silane coupling agent, a titanic coupling agent, a silicone oil or the like so as to be given hydrophobicity of between 20 and 80%. Also usable as the fluidizing agent are fine particles of various types of resins 0.1 to 1 μm in the average particle size, the particles obtained by emulsion polymerization, soap-free emulsion polymerization, non-aqueous dispersion polymerization or the like. A mixing ratio of the fluidizing agent is preferably in the range of between 0.05 and 3 parts, or more preferably between 0.1 and 2 parts by weight per 100 parts by weight of the toner.

If the above toner has too great a volume-average particle size, the toner is reduced in the reproducibility of a high-definition image. If, on the other hand, the toner has too small a volume-average particle size, the content of fine particles increases in toner particles prepared by pulverization, resulting in reduction of the productivity and the cost efficiency. Therefore, a particle size of the toner is preferably in the range of between 5 and 15 μm, or more preferably between 6 and 10 μm. In the particle size distribution by number of the toner particles, the number of particles smaller than 4 μm in size preferably accounts for 40% or less, or more preferably 30% or less, whereas the number of particles greater than 20 μm in size preferably accounts for 1% or less.

Next, a detailed description will be given on the development system according to an embodiment of the invention with reference to the accompanying drawings.

As seen in FIG. 1, a development system of the embodiment opposes an image bearing body 1 along the axial direction thereof, which image bearing body 1 comprises a cylindrical electroconductive substrate 1*a* and a photoconductive layer 1*b* formed on the surface of the substrate 1*a*. The main body of the development system 10 includes a toner reservoir 11 for storage of a toner t, which reservoir is spaced from the image bearing body 1, and a toner feed member 11*a* disposed within the toner reservoir 11 and adapted to rotate for feeding the toner t from the toner reservoir 11 to a toner supply section 12 closer to the image bearing body 1.

The toner supply section 12 includes a rotary toner supply member 12*a*, which serves to supply the toner t in the toner supply section 12 to a developer transport member 13.

Figure 2:
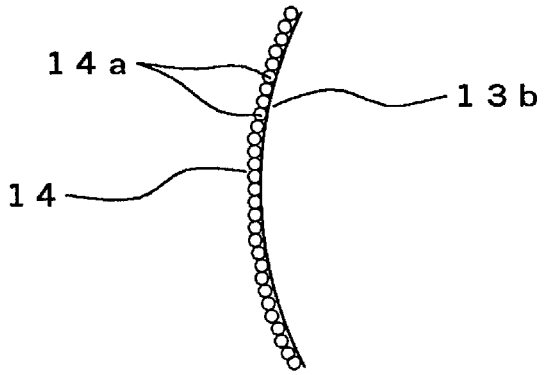
FIG. 2 is a diagram partially illustrating a layer of fine particles formed by uniformly bonding the fine particles to the surface of the developer transport member of the development system of the above mode of the invention.

In the development system of this embodiment, the developer transport member 13 comprises a drive roller 13*a* rotatably driving a developer sleeve 13*b* and axially opposing the image bearing body 1, and the developer sleeve 13*b* having a slightly greater inner diameter than the outer diameter of the drive roller 13*a* and disposed on the outer periphery of the drive roller 13*a*. As seen in FIG. 2, fine particles 14*a* with an average particle size of from 3 to 30 μm are bonded to the surface of the developer sleeve 13*b*, thereby forming a layer of the fine particles 14*a* on the developer sleeve 13*b*.

At the opposite ends of the developer sleeve 13*b*, a pressure guide 15 bears against the developer sleeve 16 on the side opposite to the image bearing body 1. The pressure guide 15 serves to bias the developer sleeve 15 against the outer circumferential surface of the drive roller 13*a* on the opposite side to the image bearing body 1 thereby allowing the rotating drive roller 13*a* to drive the developer sleeve 13*b*. At the same time, the pressure guide 15 biases the developer sleeve 13*b* away from the drive roller 13*a* toward the image bearing body 1 so as to bring the developer sleeve 13*b* into soft contact with the surface of the image bearing body 1 in a development region where the developer sleeve 13*b* opposes the image bearing body 1.

A toner regulating member 16 bears against the surface of the developer sleeve 15 with respect to a portion where the developer sleeve 15 is in contact with the drive roller 13*a*. Thus, the toner regulating member 16 serves to regulate an amount of toner t carried by the developer sleeve 13*b* driven by the rotating drive roller 13*a* while triboelectrically charging the toner t so carried.

The toner t thus regulated in the amount and triboelectrically charged by the toner regulating member 16 is carried on the developer sleeve 13*b* to the development region, where the developer sleeve 13*b* comes into contact with the image bearing member 1 for development of an image.

If, like the development system of the embodiment, the fine particles 14*a* 3 to 30 μm in the average particle size are uniformly bonded to the surface of the developer sleeve 13*b* so as to form a layer thereon, the developer sleeve 13*b* may have a preferable regular roughness in the surface thereof. The developer sleeve 13*b* with the suitable roughness is capable of carrying a suitable amount of toner t. This allows the toner regulating member 16 to suitably regulate the amount of toner t on the developer sleeve 13*b* as well as to triboelectrically charge the toner t to a suitable level.

Next, description will be given on how the development system of the embodiment develops an electrostatic latent image formed on the image bearing body 1 in a process of the image forming operation.

First, a predetermined level of voltage from a power source 2*a* is applied to a charger brush 2, which, in turn, charges the image bearing body 1 to a predetermined level of surface potential. The surface of the image bearing body 1 thus charged is exposed to light from suitable light-exposure means (not shown) whereby an electrostatic latent image is formed on the surface of the charged image bearing body Then, the developer sleeve 13*b*, provided in the development system as described above, transports the toner t to the image bearing body 1 while the toner regulating member 16 charges the toner t as regulating the amount of toner t carried on the developer sleeve 13*b*. The developer sleeve 13*b* carries thereon the charged toner t to the development region, coming into contact with the image bearing body 1 for supplying the toner t to the image bearing body 1 with the electrostatic latent image formed thereon. Thus, the latent image is developed into a toner image.

A toner t remaining on the developer sleeve 13*b*, as not supplied to the image bearing body 1, is carried back by the developer sleeve 13*b* and returned to the toner supply section 12 in the main body of the development system 10 by means of a sealing member 17 provided at the development system.

For receiving the toner image on the surface of the image bearing body 1, a copy sheet 3 is passed between the image bearing body 1 and a transfer roller 4. The transfer roller 4 is supplied by a power source 4*a* with a bias voltage having the opposite polarity to that of the charged toner t so as to transfer the toner image from the image bearing body 1 to the copy sheet 3. The copy sheet 3 with the toner image thus transferred is passed between fixing rollers 5 for fixing the transferred toner image onto the copy sheet 3. Thus, the image forming operation is completed.

It is to be noted here that, in case where the development system of the embodiment is used to develop the electrostatic latent image on the image bearing body 1, a suitable amount of toner t is carried on the developer sleeve 13*b* with the layer of the fine particles 14*a* formed on the surface thereof. This allows the toner regulating member 16 to suitably regulate the amount of toner t and to triboelectrically charge the toner t on the developer sleeve to a suitable level, whereby a suitable amount of suitably charged toner t is introduced into the development region in a stable manner.

As a result, a favorable image free from fog is produced. In addition, the resultant image does not suffer a reduced image density or density variation by virtue of the adequate supply of toner t to the image bearing body 1. Thus is assured the stable production of preferable images.

If the fine particles 14*a* having the average particle size of between 3 and 30 μm and the opposite polarity to that of the toner t are selected and uniformly bonded to the surface of the developer sleeve 13*b*, the toner t transported to the development region may be suitably regulated in the amount and also suitably charged by the toner regulating member 16. Furthermore, such fine particles 14*a* also serve to suitably charge the toner t with the opposite polarity thereto and therefore, the stable production of favorable images is assured even under conditions of high temperature and high humidity.

Furthermore, if the fine particles 14*a* having the average particle size of between 3 and 30 μm and a volume resistivity of between $10^5$ and $10^{13}$ Ω·cm are selected and uniformly bonded to the surface of the developer sleeve 13*b*, the toner t transported to the development region may be suitably regulated in the amount and charged by the toner regulating member 16. Additionally, such a layer of the fine particles 14*a* is effective for preventing the leakage of a developing bias voltage applied between the developer sleeve 13*b* and the image bearing body 1 for the development of images and hence, the development region is subjected to a sufficient electric field. This assures the stable production of preferable images free from density variation or image disturbances, rich in the image density and excellent in the reproducibility of fine lines and dots.

Although the development system of the embodiment employs the developer sleeve 13*b* driven by the drive roller 13*a* as the developer transport member 13 for carrying the toner t to the development region opposite to the image bearing body 1, the developer transport member 13 should not be limited to this. It is obvious to those skilled in the art that various types of developing rollers such as formed of a metal or rubber are applicable.

Next, description will be made on specific examples of the toner t and the fine particles 14*a* bonded to the surface of the developer sleeve 13*b* as well as the modifications thereof, which were used in the development system according to the above embodiment of the invention. In addition, comparative examples are given to clarify the superiority of the development system according to the embodiment of the invention.

(EXAMPLE 1)

A toner t prepared in the following steps was used in the development system of this example.

In preparation of the toner t, used for forming the binder resin were a low-molecular-weight polyester resin and a polyester resin to be polymerized, which were prepared in the following steps, respectively.

To obtain the low-molecular weight polyester resin, a 4-necked flask of 5-litter equipped with a reflux condenser, a water separator, a nitrogen inlet tube, a thermometer and an agitator was installed in a mantle heater. 1221 g of a bisphenol propylene oxide adduct, 155 g of a bisphenol ethylene oxide adduct, 372 g of isophthalic acid, and 100 g of terephthalic acid were put into the 4-necked flask for dehydration polycondensation at a temperature of 240° C. with nitrogen gas introduced into the 4-necked flask, thereby giving the low-molecular-weight polyester resin having a glass transition temperature Tg of 63° C.

In preparing the polyester resin to be polymerized, a 4-necked flask was installed in the mantle heater similarly to the preparation of the aforesaid low-molecular-weight polyester resin. Then, 1720 g of a bisphenol propylene oxide adduct, 860 g of isophthalic acid, 119 g of succinic acid, 130 g of diethylene glycol, and 75.6 g of glycerin were put into the flask for dehydration polycondensation at a temperature of 240° C. with nitrogen gas introduced into the flask, thereby giving the polyester resin to be polymerized, which had a glass transition temperature Tg of 42° C.

Subsequently, 3500 parts by weight of the resultant low-molecular-weight polyester rein and 1500 parts by weight of the polyester resin to be polymerized were fully agitated in a Henschell Mixer for homogenization. Then, 100 parts by weight of diphenyl methane-4,4-diisocyanate was added to the resultant mixture and were kneaded together in a heat kneader for 1 hour of polymerization reaction at 120° C. Thus, the polyester resin to be polymerized formed a polymer. After confirmation of substantial absence of residual liberated isocyanate group based on the measurement of NCO %, the resultant product was cooled to give a polyester resin having a urethane bond. The resultant polyester resin had a glass transition point Tg of 65° C., a softening point Tm of 140° C., an acid value of 25 KOHmg/g and a melt index MI of 3.6 (150° C./10 min). 100 parts by weight of the above polyester resin, 4 parts by weight of carbon black as a colorant (available commercially as Raven 1255 from Columbia Carbon Inc.), 3 parts by weight of charge control agent (available commercially as Bontron S-34 from Orient Chemical Co.,Ltd.), and 2.5 parts by weight of oxidized low-molecular-weight polypropylene as an anti-offset agent (available commercially as Viscol TS-200 from Sanyo Chemical Industries Ltd.) were fully blended in the Henschell mixer. After kneaded by a twin-screw extruder/kneader, the resultant mixture was allowed to cool and then, was roughly pulverized. The particles were further pulverized into fine particles by means of a supersonic jet pulverizer (available from Japan Pneumatic Industries Co.,Ltd.) and classified by a classifier (available as Elbow-jet from Matsuzaka Trading Co.,Ltd.), thus giving toner particles with a volume-average particle size of 8.5 μm. The toner particles contained 21.4% by number of particles smaller than 4 μm in particle size and 0.5% by volume of particles greater than 20 μm in particle size.

Next, 0.5% by weight of hydrophobic silica (available commercially as H200 from Hoechst Inc.) was added to the above toner particles, which were agitated in a 9-litter Henschell mixer at 2500 rpm for 2 minutes so as to form the toner having the surface thereof coated with hydrophobic silica. The resultant toner had a shape factor SF-1A of 185.

On the other hand, fine particles 14*a* prepared in the following steps were bonded to the surface of the developer sleeve of the development system of this example.

In preparing the fine particles 14*a*, 100 parts by weight of styrene-acrylic resin (available commercially as FB-1157 from Mitsubishi Rayon Co.,Ltd.) and 6 parts by weight of low-molecular-weight polypropylene wax (available commercially as Viscol 550P from Sanyo Chemical Industries Ltd.) were fully blended in the Henschell mixer. After kneaded by the twin-screw extruder/kneader, the resultant mixture was allowed to cool and then, was roughly pulverized by a feather mill. The particles were further pulverized into fine particles by a Cryptron pulverlizer (available from Kawasaki Heavy Industries Ltd.) and were classified by the aforesaid elbow-jet classifier, thus giving the fine particles with a volume-average particle size of 10.8 μm. The fine particles had a shape factor SF-1B of 163.

A 1% dilute solution of an adhesive (available commercially as Design-Bond S from Sumitomo 3M Inc.) was applied to the surface of the developer sleeve 13*b* and was dried. The aforesaid fine particles 14*a* were bonded to the surface of the developer sleeve 13*b* and removed of excessive fine particles by means of an air gun, thus forming a uniform layer 4 of the fine particles 14*a* on the surface of the developer sleeve 13*b*, as shown in FIG. 2.

(EXAMPLE 2)

This example was carried out in the same manner as Example 1, only except for that fine particles prepared in the following steps replaced the fine particles 14*a* bonded to the surface of the developer sleeve 13*b* of the development system of Example 1.

In preparing the fine particles 14*a* of this example, 100 parts by weight of polyester resin (available commercially as Tuffton NE-1110 from Kao Soap Co.,Ltd.) and 400 parts by weight of magnetic powder (available commercially as MFP-2 from TDK Corporation) were mixed and dispersed by the 9-litter Henschell mixer at 300 rpm for 3 minutes. After kneaded by the twin-screw extruder/kneader, the resultant mixture was allowed to cool and then, was roughly pulverized. The particles were further pulverized into fine particles by a jet mill and classified by the aforesaid Elbow-Jet classifier to give the fine particles incorporating the magnetic powder. The fine particles had a volume-average particle size of 12.6 μm and a shape factor SF-1B of 172.

(EXAMPLE 3)

A toner t prepared in the following steps was used in the development system of this example.

In preparing the toner t, 100 parts by weight of the same polyester resin as used in Example 1, 5 parts by weight of carbon black (available commercially as Mogul L from Cabot Inc.) as the colorant, and 2.5 parts by weight of oxidized low-molecular-weight polypropylene (available commercially as Viscol TS-200 from Sanyo Chemical Industries Ltd.) were used. The rest of the process was carried out in the same manner as in Example 1, thus obtaining particles with a volume-average particle size of 6.8 μm. 1.0 part by weight of charge control agent (available commercially as Spiron Black TRH from Hodogaya Chemical Co.,Ltd.) was added to the particles and blended together in a Hybridization (available from Nara Machines Co.,Ltd.) at 3500 rpm for 20 minutes and thus were obtained toner particles with a volume-average particle size of 4 μm. The toner particles contained 24.8% by number of particles smaller than 4 μm in particle size and 0.1% by volume of particles greater than 20 μm in particle size.

Thereafter, 0.5% by weight of hydrophobic silica (available commercially as Taranox 500 from Tarco Inc.) was added to the toner particles which were mixed/agitated together in the 9-litter Henschell mixer at 2500 rpm for 90 seconds, thus forming a toner having the surface thereof coated with hydrophobic silica. The toner had a shape factor SF-1A of 151.

Fine particles 14*a* bonded to the surface of the above developer sleeve 13*b* were prepared in the following steps.

To obtain the fine particles 14*a,* 95 parts by weight of styrene monomer, 5 parts by weight of divinylbenzene monomer, and 0.2 parts by weight of azobisisobutyronitrile as the polymerization initiator were put in a 4-necked flask of 3-litter equipped with the reflux condenser, the nitrogen inlet tube, the thermometer and the agitator. A 2% solution of sodium dodecylbenzensulfonate, as the dispersion stabilizer, dissolved in 1 litter of deionized water was added to the above ingredients and agitated by the aforesaid agitator(available commercially as TK Homomixer from Special Machine/Chemical Industries Ltd.) at 1500 rpm for 15 minutes and then, at 150 rpm at 70° C. in an atmosphere of nitrogen for 5 hours of polymerization reaction.

After completion of the polymerization reaction, the resultant polymer was filtered off, washed with water and dried. The polymer thus obtained was classified to give fine particles with an average particle size of 8.8 μm. The fine particles had a shape factor SF-1B of 120.

(EXAMPLE 4)

A toner t prepared in the following steps was used in the development system of this example.

In preparing the toner t of this example, 25 parts by weight of polyester resin (available commercially as Diaclon from Mitsubishi Rayon Co.,Ltd.) and 4 parts by weight of copper phthalocyanine as the colorant were first dissolved or uniformly dispersed in a mixture solvent comprising 50 parts by weight of toluene and 30 parts by weight of methylene chloride. The resultant mixture solution was put in a 3-litter beaker, to which was added 2 litter of deionized water incorporating 0.5% by weight of sodium dodecylbenzenesulfonate as the dispersion stabilizer and 1% by weight of polyvinyl alcohol (available commercially as #500 from Kanto Chemical Co.,Ltd.). The thermometer and the aforesaid agitator (available commercially as TK Homomixer from Special Machine/Chemistry Industries Ltd.) were mounted to the beaker for agitating the mixture solution at 6500 rpm for 10 minutes. Thereafter, the mixture was agitated at 2000 rpm at 40° C. for 6 hours under reduced pressure and thus was removed the mixture solvent.

Subsequently, the resultant product was filtered off and washed with water three to five times. The product was subject to vacuum drying and classified to give toner particles with a volume-average particle size of 6.5 μm. The toner particles contained 29.3% by number of particles smaller than 4 μm in particle size and 0% by volume of particles greater than 20 μm in particle size.

Subsequently, 0.5% by weight of hydrophobic silica (available commercially as Taranox 500 from Tarco Inc.) was added to the toner particles, which were homogenized by the 9-litter Henschell mixer at 2500 rpm for 90 seconds so as to form the toner having a shape factor SF-1A of 171.

Fine particles 14*a* bonded to the surface of the developer sleeve 13 were prepared in the same manner as in Example 3, except for that the speed of the aforesaid agitator (available commercially as TK Homomixer from Special Machine/Chemical Industries Ltd.) was changed. That is, the mixture solution was agitated at 750 rpm for 15 minutes and then at 200 rpm at 70° C. in an atmosphere of nitrogen for 5 hours of polymerization reaction. Thus were obtained the fine particles with an average particle size of 18.8 μm and a shape factor SF-1B of 123.

(EXAMPLE 5)

A toner t prepared in the following steps was used in the development system of this example.

In preparing the toner t, 100 parts by weight of polyester resin (available commercially as Bilon from Toyobo Co., Ltd.), 5 parts by weight of carbon black as the colorant (available commercially as Mogul L from Cabot Inc.), 1.5 parts by weight of carnauba wax (available commercially as Carnauba No.1 from Katoyoko K. K.), 1.0 part by weight of oxidized low-molecular-weight polypropylene (available commercially as Viscol TS-200 from Sanyo Chemical Industries Ltd.), and 3.5 parts by weight of a charge control agent (available commercially as Bontron S-34 from Orient Chemical Co.,Ltd.) were fully blended in the Henschell mixer and kneaded by the twin-screw extruder/kneader. The resultant mixture was allowed to cool and then, was roughly pulverized by the feather mill. The particles were further pulverized into fine particles by the Cryptron pulverizer (available from Kawasaki Heavy Industries Ltd.) and classified by a Super Separator (available from Hosokawa Micron Corporation) to give toner particles having a volume-average particle size of 14.7 μm. The toner particles contained 8.6% by number of particles smaller than 4 μm in particle size and 0.9% by volume of particles greater than 20 μm in particle size.

Subsequently, 0.4% by weight of hydrophobic silica (available commercially as Taranox 500 from Tarco Inc.) was added to the toner particles, which were homogenized by the 9-litter Henschell mixer at 2700 rpm for 90 seconds to form the toner. The toner had a shape factor SF-1A of 148.

On the other hand, calcined alumina powder having an average particle size of 4.5 μm (available from Showa Denko K. K.) was used as the fine particles 14*a* bonded to the surface of the developer sleeve 13*b*. The fine particles had a shape factor SF-1B of 136.

(EXAMPLE 6)

In the development system of this example, the same toner t as in Example 1 was used while the same fine particles 14*a* as in Example 3 were bonded to the surface of the developer sleeve 13*b*.

(EXAMPLE 7)

The same toner t as in Example 1 was used in the development system of this example.

On the other hand, fine particles 14*a* prepared in the following steps were bonded to the surface of the developer sleeve 13*b*.

In preparing the fine particles 14*a*, 95 parts by weight of styrene monomer, 5 parts by weight of ethylene glycol dimethacrylate monomer, and 0.2 parts by weight of azobisisobutyronitrile as the polymerization initiator were added to a deionized water incorporating 1% by weight of sodium dodecylbenzenesulfonate as the dispersion stabilizer. The mixture solution was agitated by the aforesaid agitator (available commercially as TK Homomixer from Special Machine/Chemical Industries Ltd.) at 8000 rpm for 15 minutes and then, at 150 rpm at 60° C. in an atmosphere of nitrogen for 5 hours of polymerization reaction. The resultant product was heated at 80° to 90° C. for 1 hour and then, was filtered off. The product was washed with water, dried and classified to give the fine particles with an average particle size of 6.7 μm. The fine particles had a shape factor SF-1B of 104.

(EXAMPLE 8)

A toner t prepared in the following steps was used in the development system of this example.

In preparing the toner t, 70 parts by weight of styrene monomer, 30 parts by weight of n-butyl methacrylate monomer, 6 parts by weight of carbon black as the colorant (available commercially as Raven 1225 from Columbia Carbon Inc.), and 0.5 parts by weight of lauryl peroxide were added to a deionized water incorporating 1% by weight of sodium dodecylbenzenesulfonate as the dispersion stabilizer. The mixture solution was agitated by the aforesaid agitator (available commercially as TK Homomixer from Special Machine/Chemical Industries Ltd.) at 6000 rpm for 15 minutes and then, at 150 rpm at 70° C. in an atmosphere of nitrogen for 5 hour of polymerization reaction. Subsequently, the resultant product was filtered off, washed with water, dried and classified to give toner particles with a volume-average particle size of 7.5 μm. The toner particles contained 38.3% by number of particles smaller than 4 μm in particle size and 0.1% by weight of particles greater than 20 μm in particle size. 0.6% by weight of hydrophobic silica (available commercially as R-974 from Nippon Aerosil K. K.) was added to the toner particles, which were mixed and agitated in the 9-litter Henschell mixer at 2500 rpm for 90 seconds to form the toner having the surface thereof coated with the hydrophobic silica. The toner had a shape factor SF-1A of 126.

On the other hand, the same fine particles 14*a* as in Example 3 were bonded to the surface of the developer sleeve 13*b*.

(COMPARATIVE EXAMPLE 1)

In the development system of this comparative example, the same toner as in the aforesaid Example 3 was used and soap-free emulsion polymer particles with an average particle size of 1 μm (available commercially as MP-1400 from Soken Chemical Ltd.) were used as the fine particles 14*a* bonded to the surface of the developer sleeve 13*b*. The soap-free emulsion polymer particles had a shape factor SF-1B of 106.

(COMPARATIVE EXAMPLE 2)

In the development system of this comparative example, the same toner t as in the aforesaid Example 1 was used and used as the fine particles 14*a* bonded to the surface of the developer sleeve 13*b* were fine particles having the same composition as the fine particles 14*a* of Example 1 but having an average particle size of 32.6 μm and a shape factor SF-1B of 156.

Now, the following Table 1 shows the respective particle sizes and shape factors SF-1A or SF-1B of the toners t and the fine particles 14*a* of Examples 1 to 8 and Comparative Examples 1 and 2. The table also shows the respective differences |A–B| between the shape factors SF-1A of the toners t and the shape factors SF-1B of the fine particles 14*a* of the Examples 1 to 8 and Comparative Examples 1 and 2.

TABLE 1

| | Particle Size (μm) | | | | |
|---|---|---|---|---|---|
| | Toner | Fine Particle | A | B | \|A – B\| |
| Ex. 1 | 8.5 | 10.8 | 185 | 163 | 22 |
| Ex. 2 | 8.5 | 12.6 | 185 | 172 | 13 |
| Ex. 3 | 7.1 | 8.8 | 151 | 120 | 31 |
| Ex. 4 | 6.5 | 18.8 | 171 | 123 | 48 |
| Ex. 5 | 14.7 | 4.5 | 148 | 136 | 12 |
| Ex. 6 | 8.5 | 8.8 | 185 | 120 | 65 |
| Ex. 7 | 8.5 | 6.7 | 185 | 104 | 81 |
| Ex. 8 | 7.5 | 8.8 | 126 | 120 | 6 |
| C.Ex. 1 | 7.1 | 1 | 151 | 106 | 45 |
| C.Ex. 2 | 8.5 | 32.6 | 185 | 156 | 23 |

Next, each of the development systems of Examples 1 to 8 and Comparative Examples 1 and 2 was used to produce copies of an image with a black area against a white area in the ratio of 4% (B/W ratio) at a speed of 20 copies per min. At each production of the 2000-th, the 8,000-th, 12,000-th and the 20,000-th copy, the resultant image was evaluated for the image density, the density variation, and the fog. At the same time, the evaluation was made on a degree of the toner fixing on the toner regulating member 16. The results are shown in Table 2.

In evaluating the image density shown in Table 2, reflection densities (I.D.) of each image was measured by Sakura Densitometer and raged on ○-to-× scale (A being best). That is, an image with an I.D. greater than 1.4 was given ○, an image with an I.D. of between 1.2 and 1.4 was given Δ, an image with an I.D. smaller than 1.2 was given ×. As to the evaluation of the density variation and the fog, each of the images was visually inspected and rated on ○to-× scale. That is, a favorable image free from the density variation or fog was given ○; an image practically acceptable despite some degree of density variation and fog was given Δ; and an image unacceptable because of heavy density variation and fog was given ×. On the other hand, the toner regulating members 16 were each observed by means of a metaloscope for evaluation of the toner fixed thereon and rated on ○-to-× scale. That is, a development system presenting no toner fixing was given ○; a development system practically acceptable despite some degree of toner fixing observed was given Δ; and a development system unacceptable because of heavy toner fixing was given ×.

TABLE 2

| | | Examples | | | | | | | | C. Ex. | |
|---|---|---|---|---|---|---|---|---|---|---|---|
| | | 1 | 2 | 3 | 4 | 5 | 6 | 7 | 8 | 1 | 2 |
| 2000-th copy | I.D. | ○ | ○ | ○ | ○ | ○ | ○ | ○ | ○ | X | ○ |
| | D.V. | ○ | ○ | ○ | ○ | ○ | ○ | ○ | ○ | Δ | ○ |
| | T.F. | ○ | ○ | ○ | ○ | ○ | ○ | ○ | ○ | ○ | ○ |
| | Fog | ○ | ○ | ○ | ○ | ○ | ○ | ○ | ○ | ○ | X |

TABLE 2-continued

| | | Examples | | | | | | | | C. Ex. | |
|---|---|---|---|---|---|---|---|---|---|---|---|
| | | 1 | 2 | 3 | 4 | 5 | 6 | 7 | 8 | 1 | 2 |
| 8000-th copy | I.D. | ○ | ○ | ○ | ○ | ○ | ○ | ○ | Δ | X | ○ |
| | D.V. | ○ | ○ | ○ | ○ | ○ | ○ | ○ | ○ | X | ○ |
| | T.F. | ○ | ○ | ○ | ○ | ○ | ○ | Δ | ○ | ○ | ○ |
| | Fog | ○ | ○ | ○ | ○ | ○ | ○ | ○ | Δ | ○ | X |
| 12000-th copy | I.D. | ○ | ○ | ○ | ○ | ○ | ○ | ○ | Δ | X | ○ |
| | D.V. | ○ | ○ | ○ | ○ | ○ | ○ | Δ | ○ | X | ○ |
| | T.F. | ○ | ○ | ○ | ○ | ○ | ○ | Δ | ○ | ○ | ○ |
| | Fog | ○ | ○ | ○ | ○ | ○ | ○ | Δ | Δ | ○ | X |
| 20000-th copy | I.D. | ○ | ○ | ○ | ○ | ○ | ○ | ○ | Δ | X | ○ |
| | D.V. | ○ | ○ | ○ | ○ | ○ | ○ | Δ | ○ | X | ○ |
| | T.F. | ○ | ○ | ○ | ○ | ○ | Δ | Δ | ○ | ○ | ○ |
| | Fog | ○ | Δ | ○ | ○ | Δ | ○ | Δ | Δ | ○ | X |

Note: in the Table, "I.D." represents image density, "D.v." density variation, and "T.F." toner fixing.

As apparent from the above table, the development systems of Examples 1 to 8, wherein the fine particles 14*a* having the average particle size of between 3 and 30 μm were bonded to the respective surfaces of the developer sleeves 13*b*, provided favorable images with sufficient image density but with little density variation or fog, even after the production of 20000 copies. Furthermore, the toner fixing on the toner regulating members 16 was also reduced.

In contrast, the development system of Comparative Example 1, wherein the fine particles 14*a* smaller than 3 μm in the average particle size were bonded to the surface of the developer sleeve 13*b*, failed to produce images with sufficient image density because the developer sleeve 13*b* had a poor transportability of the toner t. Additionally, the resultant images suffered heavy density variation.

In the development system of Comparative Example 2 wherein the fine particles 14*a* greater than 30 μm in the average particle size were bonded to the surface of developer sleeve 13*b*, the developer sleeve 13*a* carried an excessive amount of toner t, which failed to be sufficiently charged by the toner regulating member 16 and therefore, the resultant images suffered fogs.

A comparison was also made among the development systems of Examples 1 to 8. In the development system of Example 7 wherein the difference |A−B| between the shape factor SF-1A of the toner t and the shape factor SF-1B of the fine particles 14*a* on the surface of the developer sleeve 13*b* was greater than 80, such a great difference in the shapes of the toner t and the fine particles 14*a* caused the fine particles 14*a* to be scraped off from the surface of the developer sleeve 13*b* or caused fracture of the toner t while the toner regulating member 16 regulated the amount of toner t carried on the developer sleeve 13*b*. This resulted in the toner t fixed on the toner regulating member 16. Such toner fixing did not pose a serious trouble in practical use but gradually increased the degree of density variation and fog with an increasing number of copies produced. In the development system of Example 8 with the above difference |A−B| smaller than 10, the toner regulating member 16 was reduced in the capability of triboelectrically charging the toner t due to such a small difference in the shapes of the toner t and the fine particles 14*a*. The reduced capability of the toner regulating member 16 did not pose a serious trouble in practical use but gradually increased the degree of fog with an increasing number of copies produced.

It was found from the results that a preferable difference |A−B| between the shape factor SF-1A of the toner t and the shape factor SF-1B of the fine particles 14*a* on the surface of the developer sleeve 13*b* is in the range of between 10 and 80, as suggested by the development systems of Examples 1 to 6.

(EXAMPLE 9)

A negative-charge toner t prepared in the following steps was used in the development system of this example.

In preparation of the toner t, used for forming the binder resin were a low-molecular-weight polyester resin and a polyester resin to be polymerized, which were prepared in the following steps, respectively.

To prepare the low-molecular-weight polyester resin, a 4-necked flask of 5-litter, equipped with the reflux condenser, the water separator, the nitrogen inlet tube, the thermometer and the agitator, was installed in a mantle heater. 1100 g of bisphenol propylene oxide adduct, 150 g of bisphenol ethylene oxide adduct, 290 g of isophthalic acid, and 195 g of terephthalic acid were put into the flask for dehydration polycondensation at a temperature of 250° C. with nitrogen gas introduced into the flask, thereby giving the low-molecular weight polyester resin with a glass transition point Tg of 66.7° C.

To obtain the polyester resin to be polymerized, a 4-necked flask was installed in the mantle heater in the same manner as in the preparation of the aforesaid low-molecular-weight polyester resin. Then, 1500 g of bisphenol propylene oxide adduct, 915 g of isophthalic acid, 95 g of succinic acid, 185 g of diethylene glycol and 95.6 g of glycerin were put into the flask for dehydration polycondensation at a temperature of 240° C. with nitrogen gas introduced into the flask, thereby giving the polyester resin to be polymerized having a glass transition point Tg of 32° C.

Subsequently, 3800 parts by weight of the low-molecular-weight polyester resin and 1300 parts by weight of polyester resin to be polymerized thus obtained were fully agitated in the Henschell mixer for homogenization. Thereafter, 120 parts by weight of diphenylmethane-4,4-di-isocyanate was added to the resultant mixture to be kneaded at 120° C. in the heat kneader for 1 hour of polymerization of the polyester resin to be polymerized. After confirmation of substantial absence of residual liberated isocyanate group based on the measurement of NCO %, the resultant product was cooled to give a polyester resin having a urethane bond. The polyester resin had a glass transition point Tg of 64.8° C., a softening point Tm of 151° C., an acid value of 27.3 KOHmg/g and a melt index MI of 3.3 (150° C. /10 min).

Then, 100 parts by weight of the above polyester resin, 5 parts by weight of carbon black as the colorant (available commercially as Special Black 6 from Degussa AG), 3.5 parts by weight of negative-charge-control agent (available commercially as Bontron S-34 from Orient Chemical Co., Ltd.), 1.0 part by weight of oxidized low-molecular-weight polypropylene (available commercially as Viscol TS-200 from Sanyo Chemical Industries Ltd.), and 1.5 parts by weight of carnauba wax (available from Katoyoko K. K.) were fully blended in the Henschell mixer. After kneaded by the twin-screw extruder/kneader, the resultant mixture was allowed to cool and then, was roughly pulverized. The particles were further pulverized into fine particles by means of the supersonic jet pulverizer (available from Japan Pneumatic Industries Co.,Ltd.) and classified by the classifier (available as Elbow-jet from Matsuzaka Trading Co.,Ltd.) to give toner particles having a volume-average particle size of 8.0 μm. The toner particles contained 18.6% by number of particles smaller than 4 μm in size and 0.2% by volume of particles greater than 20 μm in size.

Next, 0.5% by weight of hydrophobic silica (available commercially as Taranox 500 from Tarco Inc.) was added to the toner particles which were mixed and agitated together in the 9-litter Henschell mixer and thus, was formed the negative-charge toner with the surface thereof coated with the hydrophobic silica. The toner had a shape factor SF-1A of 185.

In the development system of this example, positive-charge fine particles 14*a* were bonded to the surface of the developer sleeve 13*b*.

In preparing the fine particles 14*a*, 60 parts by weight of styrene monomer, 35 parts by weight of n-butyl methacrylate monomer, 5 parts by weight of 2-dimethylaminoethyl methacrylate monomer, and 0.2 parts by weight of azobisisobutyronitrile as the polymerization initiator were put in a 4-necked flask of 3 litter equipped with the reflux condenser, the nitrogen inlet tube, the thermometer and the agitator. 1 litter of deionized water incorporating 1% by weight of sodium dodecylbenzenesulfonate and 0.5% by weight of dispersion stabilizer (polyvinyl alcohol DP at 500) was added to the mixture and agitated by the aforesaid agitator (available commercially as TK Homomixer from Special Machine/Chemical Industries Ltd.) at 4000 rpm for 15 minutes and then, at 200 rpm at 70° C. in an atmosphere of nitrogen for 6 hours of polymerization reaction.

After completion of the polymerization reaction, the resultant polymer was filtered off, washed with water and dried. The resultant polymer was classified by the aforesaid classifier (available commercially as Elbow Jet from Matsuzaka Trading Co.,Ltd.) and thus, were obtained the positive-charge fine particles with an average particle size of 6.5 μm. The fine particles had a shape factor SF-1B of 121.

Subsequently, a 1% dilute solution of an adhesive (available commercially as Design-Bond S from Sumitomo 3M Inc.) was applied to the surface of the developer sleeve 13*b* and was dried. The aforesaid positive-charge fine particles 14*a* were bonded to the surface of the developer sleeve 13*b* and removed of excessive fine particles by means of an air gun, thus forming a uniform layer 4 of the fine particles 14*a* on the surface of the developer sleeve 13*b*, as shown in FIG. 2.

(EXAMPLE 10)

This example was carried out in the same manner as the aforesaid Example 9, except for that fine particles 14*a* prepared in the following steps were bonded to the surface of the developer sleeve 13*b* of the development system.

In preparing the fine particles 14*a* of this example, 100 parts by weight of styreneacrylic resin (available commercially as FB-1157 from Mitsubishi Rayon Co.,Ltd.), and 5 parts by weight of positive-charge control agent (available commercially as Bontron P-53 from Orient Chemical Co., Ltd.) were mixed and dispersed by the 9-litter Henschell mixer at 3000 rpm for 3 minutes. After kneaded by the twin-screw extruder/kneader, the resultant mixture was allowed to cool and then, was roughly pulverized by the feather mill. The particles were further pulverized into fine particles by the supersonic jet pulverizer (available from Japan Pneumatic Industries Co.,Ltd.) and classified by the classifier (available commercially as Super Selector from Hosokawa Micron Corporation) to give the positive-charge fine particles with an average particle size of 5.6 μm and a shape factor SF-1B of 158.

(EXAMPLE 11)

A negative-charge toner t prepared in the following steps was used in the development system of this example.

In preparing the toner t, 100 parts by weight of polyester resin (available commercially as Diaclon 684 from Mitsubishi Rayon Co.,Ltd.), 4 parts by weight of copper phthalocyanine as the colorant, and 5 parts by weight of negative-charge control agent (available commercially from Bontron E-84 from Orient Chemical Co.,Ltd.) were mixed and dispersed by the 9-litter Henschell mixer at 3000 rpm fro 2 minutes. After kneaded by the twin-screw extruder/kneader, the resultant mixture was allowed to cool and then, was roughly pulverized by the feather mill. The particles were further pulverized into fine particles by the Cryptron pulverizer (available from Kawasaki Heavy Industries Ltd.) and classified by the aforesaid classifier (available commercially as Super Separator from Hosokawa Micron Corporation) to give toner particles having an average particle size of 10.3 μm. The toner particles contained 7.5% by number of particles smaller than 4 μm in size and 0.5% by volume of particles greater than 20 μm in size.

Thereafter, 1% by weight of hydrophobic titanium (available commercially as T-805 from Nippon Aerosil K. K.) was added to the toner particles t, which were blended together in the Henschell mixer at 3000 rpm for 3 minutes. 0.4% by weight of hydrophobic silica (available commercially as Taranox from Tarco Inc.) was further added and agitated by the Henschell mixer at 2500 rpm for 90 seconds so as to form the negative-charge toner with the surface thereof coated with the hydrophobic titanium and silica. The toner had a shape factor SF-1A of 148.

As the positive-charge fine particles 14*a* bonded to the surface of the developer sleeve 13*b*, an alumina powder (available commercially as A0-500 from Admatex Inc.) with an average particle size of 5.1 μm and a shape factor SF-1B of 108, which was obtained by classification, was treated with 3% by weight of γ-aminopropyltriethoxysilane (available from the Shin-Etsu Chemical Co.,Ltd.).

(EXAMPLE 12)

A negative-charge toner t prepared in the following steps was used in the development system of this example.

In preparing the toner t, 20 parts by weight of polyester resin (available commercially as Bilon 200 from Toyobo Co.,Ltd.), 5 parts by weight of carbon black (available commercially as Mogul L from Cabot Inc.) as the colorant, 2.5 parts by weight of negative-charge control agent (available commercially as Bontron S-34 from Orient Chemical Co.,Ltd.), and 1.0 part by weight of oxidized low-molecular-weight polypropylene (available commercially as Viscol TS-200 from Sanyo Chemical Industries Ltd.) were dissolved or uniformly dispersed in a mixture solvent comprising 50 parts by weight of toluene and 15 parts by weight of methyl ethyl ketone. The mixture solution along with 2 litter of deionized water incorporating 0.3% by weight of sodium dodecylbenzenesulfonate, as a dispersant, and 1% by weight of polyvinyl alcohol were put in a 3-litter beaker equipped with the thermometer and the agitator (available commercially as TK Homomixer from Special Machine/Chemical Industries Ltd.). The resultant mixture was agitated by the agitator at 7000 rpm for 15 minutes and then, at 200 rpm for removal of the aforesaid mixture solvent.

Subsequently, the resultant product was filtered off, washed with water three to five times, and subjected to vacuum drying. The resultant particles were classified to give toner particles with a volume-average particle size of 7.1 μm. The toner particles contained 20.5% by number of particles smaller than 4 μm in size and 0% by volume of particles greater than 20 μm in size.

Subsequently, 0.5% by weight of hydrophobic silica (available commercially as R-974 from Nippon Aerosil K. K.) was added to the toner particles, which were homogenized by the Henschell mixer at 2500 rpm for 90 seconds to form the negative-charge toner. The toner had a shape factor SF-1A of 135.

On the other hand, the same positive-charge fine particles 14*a* as used in Example 9 were bonded to the surface of the developer sleeve 13*b*.

(EXAMPLE 13)

A negative-charge toner t prepared in the following steps was used in the development system of this example.

In preparing the toner t, 70 parts by weight of styrene monomer, 30 parts by weight of n-butyl methacrylate monomer, 6 parts by weight of carbon black as the colorant (available commercially as Raven 1255 from Columbia Carbon Inc.), 3 parts by weight of negative-charge control agent (available commercially as Bontron S-34 from Orient Chemical Co.,Ltd.), and 0.5 parts by weight of lauryl peroxide as the polymerization initiator were added to a deionized water incorporating 1% by weight of sodium dodecylbenzenesulfonate as the dispersion stabilizer. The mixture solution was agitated by the aforesaid agitator (TK Homomixer available from Special Machine/Chemical Industries Ltd.) at 6000 rpm for 15 minutes and then, at 150 rpm at 70° C. in an atmosphere of nitrogen for 5 hours of polymerization reaction. The resultant product was filtered off, washed with water, dried and classified to give toner particles with a volume-average particle size of 8.5 μm. The toner particles contained 16.5% by number of particles smaller than 4 μm in size and 0.2% by volume of particles greater than 20 μm in size.

Then, 0.4% by weight of hydrophobic silica (available commercially as Taranox from Tarco Inc.) was added to the toner particles, which were homogenized by the Henschell mixer at 2500 rpm for 90 seconds to form the negative-charge toner. The toner had a shape factor SF-1A of 125.

On the other hand, the same positive-charge fine particles 14*a* as used in Example 7 were bonded to the surface of the developer sleeve 13*b*.

(EXAMPLE 14)

The same negative-charge toner t as in Example 9 was used in the development system of this example. On the other hand, positive-charge fine particles (available commercially as Ebocolor BP-1004 from Nippon Shyokubai K. K.) comprising a benzoguanamine resin with carbon black dispersed therein were used as the fine particles 14*a* bonded to the developer sleeve 13*b*. The positive-charge fine particles had an average particle size of 4.0 μm and a shape factor SF-1B of 104.

(EXAMPLE 15)

A positive-charge toner t prepared in the following steps was used in the development system of this example.

In preparing the toner t, 100 parts by weight of styrene-acrylic resin (available commercially as FB-1157 from Mitsubishi Rayon Co.,Ltd.), 8 parts by weight of carbon black (available commercially as Regal 330R from Cabot Inc.) as the colorant, 5 parts by weight of positive-charge agent (available commercially as Nigrosine Base Ex from Orient Chemical Co.,Ltd.), and 3.5 parts by weight of anti-offset agent (available commercially as Viscol 550P from Sanyo Chemical Industries Ltd.) were mixed and dispersed by the 9-litter Henschell mixer at 3000 rpm for 2 minutes. After kneaded by the twin-screw extruder/kneader, the resultant mixture was allowed to cool and then, was roughly pulverized by the feather mill. The particles were further pulverized into fine particles by the supersonic jet pulverizer (available from Japan Pneumatic Industries Co.,Ltd.) and classified by the aforesaid classifier (available commercially as Elbow Jet from Matsuzaka Trading Co.,Ltd.) to give toner particles with an average particle size of 8.7 μm. The toner particles contained 14.9% by number of particles smaller than 4 μm in size and 0.1% by volume of particles greater than 20 μm in size.

Subsequently, 0.4% by weight of hydrophobic silica (available commercially as RA-200H from Nippon Aerosil K. K.) was added to the toner particles, which were homogenized in the Henschell mixer at 3000 rpm for 90 seconds to form the positive-charge toner. The toner had a shape factor SF-1A of 184.

On the other hand, negative-charge fine particles 14*a* prepared in the following steps were bonded to the surface of the developer sleeve 13*b*.

In preparing the fine particles 14*a*, 100 parts by weight of polyester resin (available commercially as Bilon 200 from Toyobo co.,Ltd.) and 3.5 parts by weight of negative-charge control agent (available commercially as Bontron S-34 from Orient Chemical Co.,Ltd.) were mixed and dispersed by the 9-litter Henschell mixer at 3000 rpm for 3 minutes. After kneaded by the twin-screw extruder/kneader, the resultant mixture was allowed to cool and then, was roughly pulverized by the feather mill. The particles were further pulverized into fine particles by the supersonic jet pulverizer (available from Japan Pneumatic Industries Co.,Ltd.) and classified by the classifier (available commercially as Super Separator from Hosokawa Micron Corporation) to give the negative-charge fine particles with an average particle size of 7.3 μm and a shape factor SF-1B of 161.

(COMPARATIVE EXAMPLE 3)

In the development system of this comparative example, the same negative-charge toner t as in Example 9 was also used while fine particles 14*a* prepared in the following steps were bonded to the surface of the developer sleeve 13*b*.

In preparing the fine particles 14*a*, 100 parts by weight of styrene-acrylic resin (available commercially as FB-1157 from Mitsubishi Rayon Co.,Ltd.), and 5 parts by weight of styrene-aminoacrylic resin (available commercially as Lunaveil 912 from Arakawa Chemical Industries Ltd.) were mixed and dispersed by the Henschell mixer at 2500 rpm for 2 minutes. After kneaded by the twin-screw extruder/kneader, the resultant mixture was allowed to cool and then, was roughly pulverized. The particles were further pulverized into fine particles by the Cryptron pulverizer (available from Kawasaki Heavy Industries Ltd.) and classified by the aforesaid classifier (available commercially as Super Separator from Hosokawa Micron Corporation) to give the fine particles having an average particle size of 30.5 μm and a shape factor SF-1B of 161.

(COMPARATIVE EXAMPLE 4)

The same negative-charge toner t as in Example 9 was also used in the development system of this comparative example. On the other hand, fine particles 14*a* bonded to the surface of the developer sleeve 13*b* were prepared in the same manner as in Comparative Example 2, except for that the pulverization and classification conditions were changed. The resultant fine particles 14*a* had an average particle size of 2.8 μm and a shape factor SF-1B of 155.

Now, the following Table 3 shows the particle sizes and the shape factors SF-1A or SF-1B of the respective toners t and fine particles 14*a* of Examples 9 to 15 and Comparative Examples 3 and 4. The table also shows the respective differences between the shape factors SF-1A of the toners t and the shape factors SF-1B of the fine particles 14*a* of Examples 9 to 15 and Comparative Examples 3 and 4.

TABLE 3

| | Particle Size (μm) | | | | |
|---|---|---|---|---|---|
| | Toner | Fine Particle | A | B | \|A − B\| |
| Ex. 9 | 8.0 | 6.5 | 185 | 121 | 64 |
| Ex. 10 | 8.0 | 6.5 | 185 | 158 | 27 |
| Ex. 11 | 10.3 | 5.1 | 148 | 108 | 40 |
| Ex. 12 | 7.1 | 6.5 | 135 | 121 | 14 |
| Ex. 13 | 8.5 | 6.5 | 125 | 121 | 4 |
| Ex. 14 | 8.0 | 4.0 | 185 | 104 | 81 |
| Ex. 15 | 8.7 | 7.3 | 184 | 161 | 23 |
| C.Ex. 3 | 8.0 | 30.5 | 185 | 161 | 24 |
| C.Ex. 4 | 8.0 | 2.8 | 185 | 155 | 30 |

Next, each of the development systems of Examples 9 to 15 and Comparative Examples 3 and 4 was used under conditions (L/L) of low temperature (15° C.) and low humidity (30%) and conditions (H/H) of high temperature (35° C.) and high humidity (80%) to produce copies of an image with a black area against a white area in the ratio of 4% (B/W ratio) at a speed of 20 copies per min. At each production of 5000-th, 10000-th and 20000-th copy, the resultant image was evaluated for the image density, the density variation and the fog. At the same time, a degree of the toner fixing on the toner regulating member 16 was evaluated. The results are shown in Tables 4 to 6.

To evaluate the image density shown in Tables 4 to 6, reflection densities (I.D.) of the images were measured by Sakura Densitometer and rated on ○-to-× scale. That is, an image with an I.D. greater than 1.4 was given ○; an image with an I.D. of between 1.2 and 1.4 was given Δ; and an image with an I.D. smaller than 1.2 was given ×. As to the density variation and fog, the resultant images were visually inspected and rated on ○-to-× scale. That is, a favorable image free from density variation and fog was given ○; an image practically acceptable despite some degree of density variation and fog was given Δ; and an image with heavy density variation and fog was given ×. On the other hand, the toner regulating members 16 were each observed by means of the metaloscope for evaluation of the toner fixed thereon and rated on ○-to-× scale. That is, a development system free from toner fixing was given ○; a development system practically acceptable despite some degree of toner fixing observed was given Δ; and a development system with heavy toner fixing was given ×.

TABLE 4

| 5000-th | | Examples | | | | | | | C. Examples | |
|---|---|---|---|---|---|---|---|---|---|---|
| copy | | 9 | 10 | 11 | 12 | 13 | 14 | 15 | 3 | 4 |
| I.D. | (L/L) | ○ | ○ | ○ | ○ | ○ | ○ | ○ | ○ | Δ |
| | (H/H) | ○ | ○ | ○ | ○ | Δ | ○ | ○ | ○ | ○ |
| D.V. | (L/L) | ○ | ○ | ○ | ○ | ○ | ○ | ○ | ○ | Δ |
| | (H/H) | ○ | ○ | ○ | ○ | Δ | ○ | ○ | Δ | Δ |
| T.F. | (L/L) | ○ | ○ | ○ | ○ | ○ | ○ | ○ | ○ | ○ |
| | (H/H) | ○ | ○ | ○ | ○ | ○ | ○ | ○ | Δ | ○ |

TABLE 4-continued

| 5000-th | | Examples | | | | | | | C. Examples | |
|---|---|---|---|---|---|---|---|---|---|---|
| copy | | 9 | 10 | 11 | 12 | 13 | 14 | 15 | 3 | 4 |
| Fog | (L/L) | ○ | ○ | ○ | ○ | ○ | ○ | ○ | ○ | Δ |
| | (H/H) | ○ | ○ | ○ | ○ | Δ | Δ | ○ | Δ | Δ |

TABLE 5

| 10000-th | | Examples | | | | | | | C. Examples | |
|---|---|---|---|---|---|---|---|---|---|---|
| copy | | 9 | 10 | 11 | 12 | 13 | 14 | 15 | 3 | 4 |
| I.D. | (L/L) | ○ | ○ | ○ | ○ | ○ | ○ | ○ | ○ | X |
| | (H/H) | ○ | ○ | ○ | ○ | Δ | ○ | ○ | ○ | Δ |
| D.V. | (L/L) | ○ | ○ | ○ | ○ | ○ | Δ | ○ | Δ | X |
| | (H/H) | ○ | ○ | ○ | ○ | Δ | Δ | ○ | Δ | Δ |
| T.F. | (L/L) | ○ | ○ | ○ | ○ | ○ | ○ | ○ | ○ | ○ |
| | (H/H) | ○ | ○ | ○ | ○ | ○ | Δ | Δ | X | ○ |
| Fog | (L/L) | ○ | ○ | ○ | ○ | ○ | ○ | ○ | Δ | X |
| | (H/H) | ○ | ○ | ○ | ○ | Δ | Δ | Δ | X | Δ |

TABLE 6

| 20000-th | | Examples | | | | | | | C. Examples | |
|---|---|---|---|---|---|---|---|---|---|---|
| copy | | 9 | 10 | 11 | 12 | 13 | 14 | 15 | 3 | 4 |
| I.D. | (L/L) | ○ | ○ | ○ | ○ | ○ | ○ | ○ | Δ | X |
| | (H/H) | ○ | ○ | ○ | ○ | Δ | Δ | ○ | Δ | Δ |
| D.V. | (L/L) | ○ | ○ | ○ | ○ | Δ | ○ | ○ | Δ | X |
| | (H/H) | ○ | ○ | ○ | ○ | Δ | Δ | Δ | X | X |
| T.F. | (L/L) | ○ | ○ | ○ | ○ | ○ | ○ | Δ | Δ | ○ |
| | (H/H) | ○ | ○ | ○ | ○ | ○ | Δ | Δ | X | ○ |
| Fog | (L/L) | ○ | ○ | ○ | ○ | Δ | ○ | Δ | X | X |
| | (H/H) | ○ | ○ | ○ | ○ | Δ | Δ | Δ | X | X |

As apparent from the above tables, in the development systems of Examples 9 to 15 wherein the fine particles 14*a* having the average particle sizes of between 3 and 30 μm and the opposite polarity to that of the toners t were bonded to the surface of the developer sleeve 13*b*, images with sufficient image density were provided even after the production of 20000 copies. In addition, the resultant images suffered little density variation or fogs while the toner regulating members 16 suffered little toner fixing.

In the development system of Comparative Example 3 wherein the fine particles greater than 30 μm in the average particle size were bonded to the surface of the developer sleeve 13*b*, the developer sleeve 13*b* carried an excessive amount of toner t, which failed to be sufficiently charged by the toner regulating member 16. As a result, fogged images were produced.

In the development system of Comparative Example 4 wherein the fine particles 14*a* smaller than 3 μm in the average particle size were bonded to the surface of the developer sleeve 13*b*, the developer sleeve 13*b* had a poor transportability of the toner t, resulting in images with insufficient image density. Furthermore, the resultant images also suffered image variation.

A comparison was also made among the development systems of Examples 9 to 15. In the development system of Example 13 wherein the difference |A−B| between the shape factor SF-1A of the toner t and the shape factor SF-1B of the fine particles 14*a* on the surface of the developer sleeve 13*b* was smaller than 10, the toner regulating member 16 was reduced in the capability of triboelectrically charging the toner t due to such a small difference in the shapes of the toner t and the fine particles 14*a*. The reduced charging capability of the toner regulating member 16 did not pose a serious trouble in practical use but gradually increased the degree of fog on the image with an increasing number of copies produced. In the development system of Example 14 wherein the aforesaid difference |A−B| was greater than 80, such a great difference in the shapes of the toner t and the fine particles 14*a* caused the fine particles 14*a* to be scraped off from the surface of the developer sleeve 13*b* or the fracture of the toner particles while the toner regulating member 16 regulates the amount of toner t carried on the developer sleeve 13*b*. This resulted in the toner t fixed on the regulating member 16. Such toner fixing did not pose a serious trouble in practical use but gradually increased the degree of density variation and fog in the resultant images with an increasing number of copies produced.

It was thus found from the above results that a preferable difference |A−B| between the shape factor SF-1A of the toner t and the shape factor SF-1B of the fine particles 14*a* is in the range of between 10 and 80, as suggested by the development systems of Examples 9 to 12 and 15.

(EXAMPLE 16)

A toner t prepared in the following steps was used in the development system of this example.

In preparing the toner t, 100 parts by weight of polyester resin (available commercially as Tuffton from Kao Soap Co.,Ltd.) as the binder resin, 5 parts by weight of carbon black (available commercially as Special Black 6 from Degussa AG) as the colorant, 3.5 parts by weight of negative-charge control agent (available commercially as Bontron S-34 from Orient Chemical Co.,Ltd.), 1.0 part by weight of oxidized low-molecular-weight polypropylene (available commercially as Viscol TS-200 from Sanyo Chemical Industries Ltd.) and 2.5 parts by weight of carnauba wax (available from Katoyoko K. K.) were fully blended in the 9-litter Henschell mixer at 2800 rpm for 3 minutes. After kneaded by the twin-screw extruder/kneader, the resultant mixture was allowed cool and then, was roughly pulverized by the feather mill. The particles were further pulverized into fine particles by the supersonic jet pulverizer (available from Japan Pneumatic Industries Co., Ltd.) and classified by the classifier (available as Elbow Jet from Matsuzaka Trading Co.,Ltd.) to give toner particles with a volume-average particle size of 8.5 μm. The toner particles contained 15.7% by number of particles smaller than 4 μm in size and 0.1% by volume of particles greater than 20 μtm in size.

Then, 0.5% by weight of hydrophobic silica (available commercially as Taranox 500 from Tarco Inc.) was added to the toner particles, which were mixed and agitated in the Henschell mixer at 2800 rpm for 3 minutes to form the negative-charge toner t with the surface thereof coated with the hydrophobic silica. The toner had a shape factor SF-1A of 186.

On the other hand, fine particles 14*a* prepared in the following steps were bonded to the surface of the developer sleeve 13*b* of the development system of this example.

In preparing the fine particles 14*a,* 100 parts by weight of styrene monomer, 5 parts by weight of divinylbenzene monomer, 4 parts by weight of Ketchen Black EC (available from Lion-Aquzo Inc.) as an electrically-conductive material, and 0.2 parts by weight of azobisisobutyronitrile as the polymerization initiator were put in a 4-necked flask of 3-litter equipped with the reflux condenser, the nitrogen inlet tube, the thermometer and the agitator. Then, 1 litter of deionized water incorporating 1% by weight of sodium dodecylbenzenesulfonate, as the dispersant, and 0.5% by weight of dispersion stabilizer (500:polyvinyl alcohol DP) was added to the mixture, which was agitated by the agitator (available commercially as TK Homomixer from Special Machine/Chemical Industries Ltd.) at 6000 rpm for 15 minutes and then at 200 rpm at 70° C. in an atmosphere of nitrogen for 6 hours of polymerization reaction.

After completion of the polymerization reaction, the resultant polymer was filtered off, washed with water, dried, and classified by the classifier (available commercially as Elbow Jet from Matsuzaka Trading Co.,Ltd.) to give fine particles with an average particle size of 7.1 μm. The fine particles had a shape factor SF-1B of 125 and a volume resistivity ρ of $7\times10^8$ Ω·cm. In the measurement of the volume resistivity ρ of the fine particles, the fine particles were put on a circular metallic electrode in the form 1 mm in thickness and 50 mm in diameter. Laid on the fine particles was an electrode having a mass of 895.4 g and a diameter of 20 mm, upon which was laid a guard electrode with an inner diameter of 38 mm and an outer diameter of 42 mm. A DC voltage of 500 V was applied to the electrodes and a current value was read 1 minute after the voltage application so as to find the volume resistivity ρ of the fine particles.

A 1% dilute solution of an adhesive (available commercially as Design-Bond S from Sumitomo 3M Inc.) was applied to the surface of the developer sleeve 13*b* and was dried. The aforesaid fine particles 14*a* were bonded to the surface of the developer sleeve 13*b* and removed of excessive fine particles by means of an air gun, thus forming a uniform layer 4 of the fine particles 14*a* on the surface of the developer sleeve 13*b*, as shown in FIG. 2.

(EXAMPLE 17)

The same negative-charge toner t as in Example 16 was used in the development system of this example. On the other hand, fine particles 14*a* prepared in the following steps were bonded to the surface of the developer sleeve 13*b*.

In preparing the fine particles 14*a,* 100 parts by weight of styrene-acrylic resin (available commercially as FB-1157 from Mitsubishi Rayon Co.,Ltd.), and 5.0 parts by weight of carbon black (available commercially as #3750 from Mitsubishi Kagaku Corporation) as the electrically-conductive material were mixed and dispersed by the 9-litter Henschell mixer at 3000 rpm for 2 minutes. After kneaded by the twin-screw extruder/kneader, the resultant mixture was allowed to cool and then, was roughly pulverized by the feather mill. The particles were further pulverized into fine particles by the supersonic jet pulverizer (available from Japan Pneumatic Industries Co.,Ltd.) and classified by the classifier (available commercially as Super Separator from Hosokawa Micron Corporation) to give fine particles with an average particle size of 6.5 μm. The fine particles had a shape factor SF-1B of 158 and a volume resistivity ρ of $6\times10^7$ Ω·cm.

(EXAMPLE 18)

A negative-charge toner t prepared in the following steps was used in the development system of this example.

In preparing the toner t, 100 parts by weight of polyester resin (available commercially as Diaclon 684 from Mitsubishi Rayon Co.,Ltd.), 4.0 parts by weight of copper phthalocyanine as the colorant, and 3.5 parts by weight of negative-charge control agent (available commercially as Bontron E-84 from Orient Chemical Co.,Ltd.) were mixed and dispersed by the 9-litter Henschell mixer at 3000 rpm for 2 minutes. After kneaded by the twin-screw extruder/kneader, the resultant mixture was allowed to cool and then, was roughly pulverized by the feather mill. The particles were further pulverized into fine particles by the Cryptron pulverizer (available from Kawasaki Heavy Industries Ltd.) and classified the classifier (available commercially as Super Separator from Hosokawa Micron Corporation) to give toner particles with a volume average particle size of 9.6 μm. The toner particles contained 7.5% by number of particles smaller than 4 μm in size and 0% by volume of particles greater than 20 μm in size.

Subsequently, 1 part by weight of hydrophobic titanium (available commercially as T-805 from Nippon Aerosil K. K.) was added to the toner particles, which were blended in the Henschell mixer at 3000 rpm for 3 minutes. Thereafter, 0.4 parts by weight of hydrophobic silica (available commercially as Taranox 500 from Tarco Inc.) was further added to the mixture, which was mixed and agitated in the Henschell mixer at 2500 rpm for 90 seconds to form the negative-charge toner t having the surface thereof coated with the hydrophobic titanium and hydrophobic silica. The toner t had a shape factor SF-1A of 156.

On the other hand, fine particles 14*a* prepared in the following steps were bonded to the surface of the developer sleeve 13*b*.

In preparing the fine particles 14*a,* 100 parts by weight of styrene-acrylic resin (available commercially as FB-1157 from Mitsubishi Rayon Co.,Ltd.), 2.7 parts by weight of carbon black (available commercially as #3750 from Mitsubishi Kagaku Corporation) as the electrically-conductive material, and 3.5 parts by weight of charge control agent (available commercially as Bontron P-53 from Orient Chemical Co.,Ltd.) were mixed and dispersed by the 9-litter Henschell mixer at 3000 rpm for 2 minutes. After kneaded by the twin-screw extruder/kneader, the resultant mixture was allowed to cool and was roughly pulverized by the feather mill. The resultant particles were further pulverized into fine particles by the Cryptron pulverizer (available from Kawasaki Heavy Industries Ltd.) and classified by the classifier (available commercially as Super Separator from Hosokawa Micron Corporation) to give the fine particles with an average particle size of 6.3 μm. The fine particles had a shape factor SF-1B of 138 and a volume resistivity ρ of $8\times10^{11}$ Ω·cm.

(EXAMPLE 19)

A negative-charge toner t prepared in the following steps was used in the development system of this example.

In preparing the toner t, 20 parts by weight of polyester resin (available commercially as Bilon from Toyobo Co., Ltd.), 5 parts by weight of carbon black (available commercially as Mogul L from Cabot Inc.) as the colorant, 2.5 part by weight of negative-charge control agent (available commercially as Bontron S-34 from Orient Chemical Co.,Ltd.) and 1.5 parts by weight of carnauba wax (available from Katoyoko K. K.) were dissolved or uniformly dispersed in a mixture solvent comprising 85 parts by weight of toluene and 15 parts by weight of methyl ethyl ketone. The mixture solution was put in a 3-litter beaker, to which was added 2 litter of deionized water incorporating 0.3% by weight of sodium dodecylbenzenesulfonate, as the dispersant, and 1% by weight of polyvinyl alcohol. Thereafter, the thermometer and the agitator (available commercially as TK Homomixer from Special Machine/Chemical Ltd.) were mounted to the beaker so that the mixture solution was agitated at 7000 rpm for 15 minutes and then, at 200 rpm for removal of the mixture solvent.

Subsequently, the resultant product was filtered off, washed with pure water three to five times, subjected to vacuum drying and then, classified to give toner particles with a volume-average particle size of 7.1 μm. The toner particles contained 20.5% by number of particles smaller than 4 μm in size and 0% by volume of particles greater than 20 μm in size.

Then, 0.5% by weight of hydrophobic silica was added to the toner particles, which were homogenized in the Henschell mixer at 2000 rpm for 90 seconds to form the negative-charge toner t. The toner t had a shape factor SF-1A of 145.

On the other hand, fine particles 14*a* bonded to the surface of the developer sleeve 13*b* were prepared in the same manner as in Example 14, except for that the Ketchen Black EC as the electrically-conductive material was replaced by 3.5 parts by weight of carbon black (available commercially as #3750 from Mitsubishi Kagaku Corporation). The fine particles had an average particle size of 6.8 μm, a shape factor SF-1B of 126, and a volume resistivity ρ of $3\times10^{9}$ Ω·cm.

(EXAMPLE 20)

The same negative-charge toner t as in Example 16 was used in the development system of this example. On the other hand, fine particles 14*a* prepared in the following steps were bonded to the surface of the developer sleeve 13*b*.

In preparing the fine particle 14*a,* 100 parts by weight of styrene monomer, 30 parts by weight of n-butyl methacrylate monomer, 5 parts by weight of n-butyl arylate monomer, 5 parts by weight of carbon black (available commercially as #3750 from Mitsubishi Kagaku Corporation) as the electrically-conductive material, and 0.7 parts by weight of lauryl peroxide as the polymerization initiator were put in a 4-necked flask equipped with the reflux condenser, the nitrogen gas inlet tube, the thermometer and the agitator. A deionized water incorporating 0.5% by weight of sodium dodecylbenzenesulfonate as the dispersant was added to the mixture, which was agitated by the agitator (available commercially as TK Homomixer from Special Machine/Chemical Industries Ltd.) at 6500 rpm for 15 minutes and then, at 150 rpm at 65° C. in an atmosphere of nitrogen for 5 hours of polymerization reaction.

After completion of the polymerization reaction, the resultant product was heated at 85° C. for 2 hours and filtered off. The product was washed with water, dried and classified to give the fine particles with an average particle size of 6.1 μm. The fine particles had a shape factor SF-1B of 104 and a volume resistivity ρ of $7\times10^{7}$ Ω·cm.

(EXAMPLE 21)

A negative-charge toner t prepared in the following steps was used in the development system of this example.

In preparing the toner t, 100 parts by weight of styrene monomer, 30 parts by weight of n-butyl methacrylate monomer, 8 parts by weight of carbon black (available commercially as Special Black 5 from Degussa Japan Corporation), 3.5 parts by weight of negative-charge control agent (available commercially as Bontron S-34 from Orient Chemical Co.,Ltd.), and 1.0 part by weight of polymerization initiator (available commercially as V-65 from Wako-Junyaku Industries K. K.) were added to a deionized water incorporating 1% by weight of sodium dodecylbenzenesulfonate as the dispersant. The mixture solution was agitated by the aforesaid agitator (available commercially as TK Homomixer from Special Machine/Chemical Industries Ltd.) at 6000 rpm for 15 minutes and then, at 150 rpm at 70° C. in an atmosphere of nitrogen for 5 hours of polymerization reaction.

After completion of the polymerization reaction, the resultant product was heated at 85° C., filtered off, washed with water and dried. The resultant particles were classified by the aforesaid classifier (available commercially as Elbow-Jet from Matsuzaka Trading Co.,Ltd.) to give toner particles with an average particle size of 8.0 μm. The toner particles contained 14.9% by number of particles smaller than 4 μm in size and 0.1% by volume of particles greater than 20 μm in size.

Then, 0.5% by weight of hydrophobic silica (available commercially as Taranox 500 from Tarco Inc.) was added to the toner particles, which were homogenized in the Henschell mixer at 2500 rpm for 90 seconds to form the negative-charge toner t. The toner t had a shape factor SF-1A of 112.

On the other hand, the same fine particles 14*a* as in Example 20 were bonded to the surface of the developer sleeve 13*b*.

(COMPARATIVE EXAMPLE 5)

The same negative-charge toner t as in Example 16 was used in the development system of this comparative example. On the other hand, fine particles 14*a* bonded to the surface of the developer sleeve 13*b* were prepared in the same manner as in Example 17, except for that the particles were pulverized and classified under different conditions. The resultant fine particles 14*a* had an average particle size of 2.5 μm, a shape factor SF-1B of 155, and a volume resistivity ρ of $5\times10^7$ Ω·cm.

(COMPARATIVE EXAMPLE 6)

The same negative-charge toner t as in Example 16 was also used in the development system of this comparative example. On the other hand, fine particles 14*a* bonded to the surface of the developer sleeve were prepared in the same manner as in Example 17, only except for that particles were pulverized and classified under different conditions. The resultant fine particles 14*a* had an average particle size of 32.7 μm, a shape factor SF-1B of 161, and a volume resistivity ρ of $8\times10^7$ Ω·cm.

Now, Table 7 shows the respective particle sizes and shape factors SF-1A of the toners of the aforesaid Examples 16 to 21 and Comparative Examples 5 and 6, as well as the respective particle sizes and shape factors SF-1B of the fine particles 14*a* thereof. The differences between the respective shape factors SF-1a of the toners t and the respective shape factors SF-1B of the fine particles SF-1B are also shown in the table.

TABLE 7

| | Toner | | Fine Particle | | | |
|---|---|---|---|---|---|---|
| | Particle Size (μm) | A | Particle Size (μm) | B | ρ (Ω · cm) | \|A − B\| |
| Ex. 16 | 8.6 | 186 | 7.1 | 125 | $7 \times 10^8$ | 61 |
| Ex. 17 | 8.6 | 186 | 6.5 | 158 | $6 \times 10^7$ | 28 |

TABLE 7-continued

| | Toner | | Fine Particle | | | |
|---|---|---|---|---|---|---|
| | Particle Size (μm) | A | Particle Size (μm) | B | ρ (Ω · cm) | \|A − B\| |
| Ex. 18 | 9.6 | 156 | 6.3 | 138 | $8 \times 10^{11}$ | 18 |
| Ex. 19 | 7.1 | 145 | 6.8 | 126 | $3 \times 10^9$ | 19 |
| Ex. 20 | 8.5 | 186 | 6.1 | 104 | $7 \times 10^7$ | 82 |
| Ex. 21 | 8.0 | 112 | 6.1 | 104 | $7 \times 10^7$ | 8 |
| C.Ex. 5 | 8.6 | 186 | 2.5 | 155 | $5 \times 10^7$ | 31 |
| C.Ex. 6 | 8.6 | 186 | 32.7 | 166 | $8 \times 10^7$ | 20 |

Next, each of the development systems of Examples 16 to 21 and Comparative Examples 5 and 6 was used to produce copies of an image with a black area against a white area in the ratio of 4% (B/W ratio) at a speed of 20 copies per min. At each production of the 5000-th, the 10,000-th, and 20,000-th copy, the resultant image was evaluated for the image density, the density variation, the fog and the reproducibility of fine lines. At the same time, the evaluation was made on a degree of the toner fixing on the toner regulating member 16 and the toner filming over the developer sleeve 13*b*. The results are shown in Table 8.

To evaluate the image density shown in Table 8, reflection densities (I.D.) of the images were measured by Sakura Densitometer and rated on ○-to-× scale. That is, an image with an I.D. of above 1.4 was given ○; an image with an I.D. of between 1.2 and 1.4 was given Δ; and an image with an I.D. of below 1.2 was given ×.

As to the density variation and the reproducibility of fine lines, the resultant images were visually inspected and rated on ○-to-× scale, wherein a favorable image free from density variation was given ○; an image practically acceptable despite some degree of density variation was given A; and an unacceptable image due to heavy density variation was given ×. Similarly, a favorable image with excellent reproducibility of fine lines was given ○; an image practically acceptable despite somewhat reduced reproducibility of fine lines was given Δ; and an image practically unacceptable due to rather poor reproducibility of fine lines was given ×.

On the other hand, the toner filming over the developer sleeve was visually inspected and rated on ○-to-× scale wherein a developer sleeve free from the toner filming was given ○; a developer sleeve practically acceptable despite somewhat toner filming observed was given Δ; and a developer sleeve practically unacceptable due to heavy toner filming was given ×.

The regulating members 16 were each observed by means of a metaloscope for the evaluation of the toner fixing thereon and rated on ○-to-× scale, wherein a development system free from the toner fixing was given ○; and a development system practically acceptable despite some degree of toner fixing observed was given Δ; and a development system practically unacceptable due to heavy toner fixing was given ×.

TABLE 8

| | | Examples | | | | | | C. Ex. | |
|---|---|---|---|---|---|---|---|---|---|
| | | 16 | 17 | 18 | 19 | 20 | 21 | 5 | 6 |
| 5000-th copy | I.D. | ○ | ○ | ○ | ○ | ○ | ○ | Δ | ○ |
| | D.V. | ○ | ○ | ○ | ○ | ○ | ○ | Δ | ○ |
| | F.R. | ○ | ○ | ○ | ○ | ○ | ○ | Δ | ○ |
| | T.F. | ○ | ○ | ○ | ○ | ○ | ○ | ○ | ○ |
| | Filming | ○ | ○ | ○ | ○ | ○ | ○ | ○ | Δ |

TABLE 8-continued

| | | Examples | | | | | | C. Ex. | |
|---|---|---|---|---|---|---|---|---|---|
| | | 16 | 17 | 18 | 19 | 20 | 21 | 5 | 6 |
| 10000-th copy | I.D. | ○ | ○ | ○ | ○ | ○ | ○ | Δ | ○ |
| | D.V. | ○ | ○ | ○ | ○ | ○ | ○ | Δ | ○ |
| | F.R. | ○ | ○ | ○ | ○ | ○ | ○ | Δ | Δ |
| | T.F. | ○ | ○ | ○ | ○ | ○ | ○ | ○ | Δ |
| | Filming | ○ | ○ | ○ | ○ | ○ | ○ | ○ | X |
| 20000-th copy | I.D. | ○ | ○ | ○ | ○ | ○ | Δ | X | ○ |
| | D.V. | ○ | ○ | ○ | ○ | ○ | Δ | X | Δ |
| | F.R. | ○ | ○ | ○ | ○ | Δ | ○ | X | Δ |
| | T.F. | ○ | ○ | ○ | ○ | ○ | ○ | ○ | X |
| | Filming | ○ | ○ | ○ | ○ | Δ | ○ | ○ | X |

As it is apparent from the table, in the development systems of Examples 16 to 21 wherein the fine particles 14*a* with the average particle sizes of between 3 and 30 μm and the volume resistivities ρ of between $10^5$ and $10^{13}$ Ω·cm were bonded to the surfaces of the developer sleeves 13*b*, respectively, images with sufficient density were produced even after the production of 20000 copies. Furthermore, the resultant images suffered little density variation or poor reproducibility of fine lines. On the other hand, the toner fixing on the toner regulating member 16 or the toner filming over the developer sleeve 13*b* was inhibited.

On the other hand, in the development system of Comparative Example 5 wherein the fine particles 14*a* smaller than 3 μm in the average particle size were bonded to the surface of the developer sleeve 13*b*, the developer sleeve 13*b* was reduced in the transportability of the toner t, causing the resultant images to suffer insufficient image density, density variation or poor reproducibility of fine lines.

In the development system of Comparative Example 6 wherein the fine particles 14*a* greater than 30 μm in the average particle size, an excessive amount of toner t was carried by the developer sleeve 13*b*, frequently causing the toner fixing on the toner regulating member 16 or the toner filming over the developer sleeve 13*b*.

A comparison was also made among the development systems of Examples 16 to 21. In the development system of Example 20 wherein the difference |A−B| between the shape factor SF-1A of the toner t and the shape factor SF-1B of the fine particles 14*a* on the surface of the developer sleeve 13*b* was greater than 80, such a great difference in the shapes of the toner t and the fine particles 14*a* caused the fine particles to be scraped off from the surface of the developer sleeve 13*b* or the fracture of the toner t while the regulating member 16 regulates the amount of toner t carried on the developer sleeve 13*b*. This resulted in the toner filming over the developer sleeve 13*b* or reduced the reproducibility of fine lines although not posing a serious trouble in practical use.

On the other hand, in the development system of Example 21 with the above difference |A−B| of smaller than 10, the toner regulating member 16 was reduced in the capability of triboelectrically charging the toner t due to such a small difference in the shapes of the toner t and the fine particles 14*a*. This did not pose a serious trouble in practical use but gradually increased the degree of density variation with an increasing number of copies produced.

It was found from the results that a preferable difference |A−B| between the shape factor SF-1A of the toner t and the shape factor SF-1B of the fine particles 14*a* on the surface of the developer sleeve 13*b* is in the range of between 10 and 80, as suggested by the development systems of Examples 16 to 19.

Although the present invention has been fully described by way of examples with reference to the accompanying drawings, it is to be noted that various changes and modifications will be apparent to those skilled in the art.

Therefore, unless otherwise such changes and modifications depart from the scope of the invention, they should be constructed as being included therein.

What is claimed is:

1. A development system comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particle size of between 3 and 30 μm bonded with the surface.

2. A development system as set forth in claim 1, said fine particles are bonded by an adhesive layer.

3. A development system as set forth in claim 1, wherein said fine particles contains a resin and an electrically-conductive material.

4. A development system as set forth in claim 1, wherein said fine particles contains a resin and a charge control agent.

5. A development system as set forth in claim 1, wherein said fine particles contains a resin, an electrically-conductive material, and charge control agent.

6. A development system, comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particle size of between 3 and 30 μm bonded with the surface, characterized by satisfying a condition of $10 \leqq |A-B| \leqq 80$, wherein "A" denotes a shape factor SF-1A of said developer and "B" denotes a shape factor SF-1B of the fine particles.

7. A development system, comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particle size of between 3 and 30 μm bonded with the surface, wherein said layer of the fine particles contains a styrene-acrylic resin and low-molecular-weight polyolefin wax.

8. A development system as set for in claim 7, wherein said low-molecular-weight polyolefin wax is a low-molecular-weight polypropylene wax.

9. A development system, comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particle size of between 3 and 30 μm bonded with the surface, wherein said layer of fine particles contains a polyester resin and a magnetic powder.

10. A development system, comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particle size of between 3 and 30 μm bonded with the surface, wherein said layer of fine particles contains a styrene polymer.

11. A development system, comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particle size of between 3 and 30 μm bonded with the surface, wherein said fine particles contains a benzoguanamine resin and a carbon black.

12. A development system comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particles size of between 3 and 30 μm which are bonded with the surface, said fine particles having a volume resistivity between $10^5$ and $10^{13}$ Ω·cm.

13. development system as set forth in claim 12, said fine particles are bonded by an adhesive layer.

14. A development system as set forth in claim 12, wherein said fine particles contains a resin and an electrically-conductive material.

15. A development system as set forth in claim 12, wherein said fine particles contains a resin, an electrically-conductive material and a charge control agent.

16. A development system, comprising:

a developer carrier for carrying a developer on a surface thereof to a development region opposite to an image bearing body, and a regulating member biased into contact with the surface of the developer carrier by a predetermined pressure for regulating an amount of developer carried by a developer transport member, said developer carrier having a surface coated with fine particles with an average particles size of between 3 and 30 μm which are bonded with the surface, said fine particles having a volume resistivity between $10^5$ and $10^{13}$ Ω·cm, characterized by satisfying a condition of $10 \leqq |A-B| \leqq 80$, wherein "A" denotes a shape factor SF-1A of said developer and "B" denotes a shape factor SF-1B of the fine particles.

* * * * *